US008864015B2

(12) United States Patent
Lu et al.

(10) Patent No.: US 8,864,015 B2
(45) Date of Patent: Oct. 21, 2014

(54) CUP WITH INTEGRAL CLOSURE FLAPS

(75) Inventors: Wei Lu, Dublin (IE); Kenneth Duggan, Dublin (IE)

(73) Assignee: Hanpak Limited, County Laois (IE)

( * ) Notice: Subject to any disclaimer, the term of this patent is extended or adjusted under 35 U.S.C. 154(b) by 244 days.

(21) Appl. No.: 13/511,818

(22) PCT Filed: Nov. 25, 2009

(86) PCT No.: PCT/EP2009/065854

§ 371 (c)(1),
(2), (4) Date: May 24, 2012

(87) PCT Pub. No.: WO2011/063835

PCT Pub. Date: Jun. 3, 2011

(65) Prior Publication Data

US 2012/0286027 A1 Nov. 15, 2012

(51) Int. Cl.
*B65D 3/20* (2006.01)
*B65D 3/06* (2006.01)

(52) U.S. Cl.
CPC ... *B65D 3/06* (2013.01); *B65D 3/20* (2013.01)
USPC ..... 229/128; 229/404

(58) Field of Classification Search
CPC ..... B65D 3/20; B65D 43/16; B65D 43/162; B65D 2251/1016; B65D 2251/1083; A47G 19/2272
USPC ..... 229/5.5, 128, 404, 906.1
See application file for complete search history.

(56) References Cited

U.S. PATENT DOCUMENTS 1,527,830 A * 2/1925 Booker ..... 229/128
2,074,824 A * 3/1937 Karlsson-Ygger ..... 229/5.5
4,620,665 A * 11/1986 McSherry ..... 229/128

(Continued)

FOREIGN PATENT DOCUMENTS

| | | | |
|---|---|---|---|
| DE | 60206135 | T2 | 1/2006 |
| EP | 1236648 | A1 | 9/2002 |
| GB | 2380397 | A | 4/2003 |
| WO | WO 2005/012114 | A1 | 2/2005 |

OTHER PUBLICATIONS

International Search Report issued in International Application No. PCT/EP2009/065854 on Aug. 4, 2010.

*Primary Examiner* — Gary Elkins
(74) *Attorney, Agent, or Firm* — Hoffmann & Baron, LLP

(57) ABSTRACT

A frusto-conical cup (1, 20, 30, 40, 50) made from a flexible resilient material, having a circular rim (5) defining the top opening (6) of the cup. A pair of arcuate crease lines (7, 8) is formed at the opposing sides of the wall (2) of the cup below the rim defining a pair of flaps (70, 80) for closing the top opening of the cup by folding the flaps along the crease lines. Due to the resilience of the cup material, each flap can toggle between two stable positions on application of an initial external force on the flap, namely an open upright position in which the flap is convex and forms part of the wall of the cup, and a closed slanted position in which the flap changes its shape to concave. In the closed mode, the rim of one flap impinges against the inner face of the second flap and forms a spill-tight seal between the flaps. The seal is maintained due to static opposing forces acting between the flaps.

34 Claims, 6 Drawing Sheets

(56) References Cited

U.S. PATENT DOCUMENTS 4,711,389 A * 12/1987 Alba et al. ..... 229/128
D306,975 S * 4/1990 Brondyke et al. ..... D9/431
D495,209 S * 8/2004 Tranfaglia et al. ..... D7/512
2009/0114710 A1* 5/2009 Lang ..... 229/404
2009/0261156 A1* 10/2009 Abbott ..... 229/404
2013/0299567 A1* 11/2013 Herman ..... 229/404

* cited by examiner

CUP WITH INTEGRAL CLOSURE FLAPS

This application is the U.S. National Phase of, and Applicants claim priority from, International Patent Application Number PCT/EP2009/065854 filed 25 Nov. 2009, which is incorporated herein by reference.

FIELD OF THE INVENTION

The present invention relates to cups for cold and hot beverages or food and in particular to disposable cups made from flexible resilient material, such as paperboard or plastics.

BACKGROUND OF THE INVENTION

Known disposable cups, such as those used in fast food outlets or in vending machines usually comprise a body in the form of an inverted truncated cone having a closed base and an open top. To prevent spilling of the contents of the cup, a lid is usually placed over the opening of the cup. Such lids are typically moulded from a plastics material. A supply of matching lids needs to be maintained available for a user near the supply of cups at the vending location. Obviously, a lid has to be compatible with the opening of the cup so as to fit securely over the rim of the cup and to prevent spillage. There are a number of disadvantages associated with the use of such lids. Whilst having the same general configuration of a truncated cone, disposable cups come in different sizes and, therefore, for each cup size, a different lid is normally required. Maintaining a stock of matching lids for every cup size involves additional expense, requires additional storage space and managerial resources. Furthermore, it is often difficult to place even a matching lid over the cup opening in a single attempt and typically some manipulation is required before the lid is finally properly put in place. Moreover, if the lid is pressed a little too hard against the rim of the cup, the cup can tumble and cause the contents inevitably to escape the cup. Since most disposable lids are provided with a spout, there still remains a relatively high risk of spillage through the spout, e.g. when a person who is carrying the cup walks or manipulates other objects, such as keys, mobile phone, etc. Due to the incessant popularity of fast food services, enormous amounts of disposable cups and lids are being used and discarded all over the world on a daily basis. Whilst many disposable cups are made from paperboard, which is renewable and recyclable, lids are generally made from plastics which is far less environmentally friendly.

In view of the above, it is an object of the present invention to alleviate and mitigate the disadvantages of the prior art and to provide an improved arrangement for closing a disposable cup to prevent spillage of the cup contents.

SUMMARY OF THE INVENTION

Accordingly, the present invention provides a cup made from a flexible resilient material, the cup comprising a wall having a shape of a truncated cone having a central axis, a closed base of a smaller diameter at one end and a generally circular or oval rim of a larger diameter at an opposite end;

the rim defining a top opening of the cup, the cup further comprising a pair of substantially arcuate crease lines formed in the wall of the cup at opposite sides of the wall below the rim; wherein each crease line has first and second ends coinciding with the rim; wherein each crease line and the portion of the rim between the first and second ends of the crease line define a flap having an outer face and an inner face; wherein each crease line is configured to act as a hinge allowing each flap to toggle between two stable positions upon application of an initial external force on the flap, the two stable positions being an open upright position in which the flap is convex and forms part of the wall of the cup, and a closed slanted position in which the flap changes its shape to concave; wherein the resilience of the flap material causes the flap to complete the toggle and prevents the flap from stopping in a position intermediate the open upright and the closed slanted positions; and wherein the length of each crease line and the shortest distance between a point of the crease line axially most remote from the rim of the flap and the rim are selected such that when the flaps are closed, each flap assumes a slanted orientation in relation to the base of the cup, whereby the rim of a first flap impinges against the inner face of the second flap whereby the second flap remains statically forced against the rim of the first flap due to the resilience of the material of the cup thereby forming a spill-tight seal between the rim of the first flap and the inner face of the second flap, whereby the two flaps form a double slope roof across the top opening of the cup.

Ideally, all parts of the rim of the cup lie in one plane when the flaps are open and the length of the rim of each flap is shorter than the length of the crease line of that flap.

It will be appreciated that the terms “inner”, “inwardly”, “outer”, “outwardly”, “axially”, “longitudinally” or similar are used in relation to a central axis of the cone. Accordingly, the terms “convex” and “concave” are to be understood as, respectively, “bent outwardly and inwardly in relation to the central axis”. It will also be appreciated that the terms “up”, “upper” “upright”, “down”, “lower” downward” and “slanted” are used in relation to the base of the cup.

Due to the above described arrangement of the cup of the present invention, one of the flaps, e.g. the first flap, is allowed to move fully into the closed slanted position, whilst the second flap is prevented from moving fully into the closed slanted position by the rim of the first flap, whereby the rim of the first flap is prevented from being deformed by the second flap due to the resilience of the material of the cup, so that the second flap remains statically forced against the rim of the first flap towards the closed slanted position due to the resilience of the cup material.

A flap is prevented from remaining in an intermediate position because in an intermediate position the flap becomes distorted, e.g. corrugated, and is forced to assume either concave or convex shape due to the inherent resilience of the cup material. The resilience of the cup material preferably causes the flap to complete the toggle without the need for the continued application of the external force.

Because the rim of each flap is shorter than crease line of the flap, the flap assumes the inwardly slanted orientation when the flap is toggled into the closed position. In the closed position of the flaps, the inherent resilience of the material of the cup is substantially resistant to any external force attempting to push the flap down and/or inward any further, thereby rendering the flap substantially rigid and stable in the closed mode.

The counteracting forces between the rim of the first flap and the inner face of the second flap are sufficient to push the respective rim and the inner face together into a tight contact to form a substantially spill-resistant, liquid-tight seal. Such a seal is capable of preventing the contents of the cup from escaping the cup by passing between the rim of the first flap and the inner face of the second flap. Due to the configuration of the arcuate crease lines with respect to the rim of the respective flap, the flaps assume the slanted orientation when the flaps are closed and, accordingly, portions of the flaps adjacent their respective rims overlap at an angle to each other thereby forming a line (i.e. rim-to-surface) contact between the flaps, as opposed to a surface (surface-to-surface) contact. As a result, a more reliable seal is formed and a more rigid structure of the cup in the closed mode is achieved. Furthermore, when the wall of the cup is gripped, e.g. by a user, the generally circular or oval wall of the cup becomes deformed, thereby causing the counteracting forces between the rim and the inner face of the respective first and second flaps to increase, thereby further enhancing the sealing function of the flaps. Preferably, the rim of the first flap impinges against the inner face of the second flap along at least a greater portion of the length of the rim and, preferably, substantially along the full length of the rim.

Preferably, a height-radius ratio of each flap, i.e. the ratio between (a) the shortest distance between two parallel planes both of which are perpendicular the central axis of the cup, a first plane being the plane in which the rim of the cup lies and the second plane being a plane which passes through the point on one of the two arcuate crease lines axially most remote from the rim of the cup and (b) the radius of the cup in the second plane, is equal or greater than 1, but preferably less than 1.5 A shallower crease line (i.e. with the height-radius ratio being less than 1) would not allow the flaps to come into any contact with each other upon closure of the flaps and a gap between the flaps would remain even in their closed mode. A steep crease line (i.e. with the height-radius ratio being greater than 1.5) would cause central areas of the inner faces of flaps to collide upon closure of the flaps thereby causing a surface-to-surface as opposed to a forced rim-to-surface contact, and at the same time leaving gaps between the flaps adjacent the ends of the crease lines. It will be appreciated, however, that the present invention is not limited to the above arrangement and it is envisaged than one flap can have a height-radius ratio different from the other flap, each height-radius ratios not necessarily falling within the above range.

In one preferred embodiment, substantially all parts the crease line of a flap lie in one secant plane which crosses all the generating lines of the conical wall of the cup and as a result the crease line defines a part of an ellipse. Such a configuration of the crease line provides for a more stable closed position of the flap and for a more consistent line contact between the rim and the inner face of respective folded flaps. It will be appreciated that the invention is not limited to the elliptical shape of the arcuate crease lines. It will also be appreciated that portions of each arcuate crease line can have different curvatures and, indeed, be straight. In one modification, the arcuate crease line includes a pair of substantially straight portions, each substantially straight portion being located intermediate the point on the cease line most remote from the rim of the cup and the first and the second end, respectively of the arcuate crease line.

Preferred materials for the cup are flexible resilient materials such as paperboard or plastics, the paperboard being a more preferred material due to its recyclability and renewability.

In one configuration, the rim of the cup is a relatively sharp rim, e.g. formed by cutting the cup material when forming the cup, which provides for a better sealing effect between the flaps. In such a variation, preferably, the cup material is selected from a material with low liquid-absorbency, such as, e.g. high-density paperboard, so that liquid contents of the cup does not penetrate and damage the cup material at the rim. It will be appreciated that the rim can also be a known regular outwardly curled rim. In one useful modification, the rim is formed by folding over a band of material at the free edge of the cup wall on itself, for example, outwardly. Such a rim is not too sharp to render the cup inconvenient, not too round to prevent an efficient seal from being formed between the flaps and at the same time not as porous as a rim formed by cutting the cup material.

In one variation, each end of one crease line substantially coincides with a corresponding end of the other crease line on the rim of the cup so that when the flaps are folded, the rim of one flap sealingly contacts the inner face of the other flap along its entire length, i.e. from one pair of coinciding ends of the crease lines of the flaps to the other pair, thereby substantially completely preventing the contents of the cup from escaping the cup.

In another variation, a first pair of ends of the two crease lines coincide with each other and the other pair of ends of the crease lines are spaced apart along the rim of the cup defining therebetween a bridge portion of the rim, so that when the flaps are closed, a portion of the rim of the first flap adjacent the bridge portion of the rim of the cup remains spaced apart form the inner face of the second flap, whereas the remaining portion of the rim of the first flap is in the sealing contact with the inner face of the other flap, so that the bridge portion of the rim of the cup and the unsealed portions of the flaps define an opening sufficient to serve as a spout of the cup, the spout being suitable for drinking a beverage directly from the cup and/or for inserting a drinking straw into the cup through the spout.

In a preferred arrangement, a sealing arrangement is formed at the coinciding ends of the crease lines to seal any minuscule opening defined at the ends when the flaps are folded. In one variation, the sealing arrangement comprises an additional crease line extending between the crease line of a first flap and the rim of the first flap adjacent the coinciding ends of the first and the second flaps, thereby defining a sealing portion on the first flap, the sealing portion being foldable outwardly into substantial abutment with the remaining portion of the flap when the flaps are folded into the closed position, thereby sealing the minuscule opening. In another variation, an additional crease line extends between the crease lines of the first and the second flap adjacent the coinciding ends of the first and the second flaps thereby defining a sealing portion, the sealing portion being foldable inwardly or outwardly when the flaps have been folded into the closed position, thereby sealing the minuscule opening.

In a further variation, a first pair of crease lines is provided wherein each end of one crease line substantially coincides with a corresponding end of the other crease line on the rim of the cup as described above to seal the opening of the cup substantially completely. Additionally, at least one third arcuate crease line is provided on one side of the wall of the cup upwardly offset from a first crease line of the first pair. Preferably, at least one end of the third crease line is spaced apart along the rim of the cup from the corresponding end of the second crease line of the first pair defining a bridge portion of the rim of the cup. Accordingly, a first flap that has the third crease line can be folded along the third line, whereby a portion of the rim of the first flap adjacent the spaced apart ends of the third crease line and the second crease line of the first pair remains spaced apart form the inner face of the folded second flap, whereas the remaining portion of the rim of the first flap is in the sealing contact with the inner face of the other flap, so that the bridge portion of the rim of the cup and the unsealed portions of the flaps define a spout substantially as described above. Advantageously, in this variation of the cup, two modes of closing the cups are possible, a first mode in which the top opening of the cup is substantially completely closed and a second mode in which a first flap is folded along the third line so that the spout is formed. In a preferred modification, in addition to the third crease line, a fourth arcuate crease line is provided on the opposite side of the wall of the cup similar to the third crease line upwardly offset form the second crease line of the first pair. Preferably, at least one end of the fourth crease line is spaced apart along the rim of the cup from the corresponding end of the second crease line of the first pair and from the corresponding end of the third crease line, so as to define a bridge portion of the rim of the cup between the ends of the third and the fourth crease lines, so that the spout can be formed by folding the flaps along the third and the fourth lines.

In yet a further advantageous modification, the length of one crease line, for example, a first crease line, is shorter than the length of the second crease line, and the distance between a point of the first crease line axially most remote from the rim of the cup is less than the distance between a point of the second crease line axially most remote from the rim of the cup, i.e. the first crease line is shallower than the second crease line in relation to the base of the cup. Due to this arrangement, when the first flap is folded into the fully closed position, the rim of the first flap is positioned closer to the top opening of the cup than the rim of the second flap in the fully closed position and than a rim of the first flap having a crease line identical to the crease line of the second flap. Therefore, the inner face of the second flap meets the rim of first flap at a greater distance from the fully closed position of second flap than in the arrangement where the crease lines of the two flaps are equal in length and are equally spaced from the rim of the cup. As a result, the force that forces the inner face of the second flap against the rim of the first flap is greater than in the arrangement where the first and second crease lines are equal and are equally spaced from the rim of the cup, thereby providing an enhanced sealing effect between the rim of the first flap and the inner face of the second flap.

In a further advantageous variation, a substantially continuous tear line is formed extending from the rim of the first flap to the crease line of the first flap; from the crease line of the first flap to the crease line of the second flap; and from the crease line of the second flap to the rim of the second flap adjacent a location where the corresponding ends of the first and second crease lines coincide on the rim of the cup. Ideally, the tear line is formed so that when the flaps are closed, the tear line encompasses a portion of the cup wall and portions of the flaps adjacent the point on the rim where the corresponding ends of the two crease lines meet, so that upon gripping and applying a force to these portions, the tear line becomes broken and the portions of the wall of the cup and of the flaps originally surrounded by the tear line become separated from the cup thereby forming a spout defined by edges of the cup wall and the flaps exposed after the separation.

The cup of the present invention provides a number of significant advantages over known cups. First of all, no separate lid is required to close the top opening of the cup. The particular arrangement of the flaps of the cup allows the cup to close fully so that no passage of liquid or other contents of the cup through the top opening is possible. This feature of the invention makes it possible for a user to carry the cup, e.g. when walking briskly, or to hold the cup when performing various manipulations, e.g. handling keys or using a mobile phone, without the risk of spilling any amount of the contents of the cup. The cup of the inventions makes separate lids a redundant feature, thereby reducing costs, dispensing with the requirement of maintaining a stock of matching lids and with the need to provide disposal or recycling facilities for used lids, thereby rendering the cup of the invention an environmentally friendly product. The toggle action of the flaps of the cup of the invention makes the flaps much easier and safer to use than a lid. The danger of pushing the lid too hard over the rim the cup and as a result spilling the contents of the cup is eliminated. Also, when it is desired to open the cup, there no need for a user to worry about where to place the lid, which often has some of the contents of the cup adhered to the underside and is awkward and possibly unhygienic to manipulate. The flaps are integral art of the cup and can be easily closed or opened. The resilient static forces acting between the flaps provide a secure sealing contact between the rim of one flap and the inner face of the other flap which prevents spillage even of the cup is dropped for some reason. The line contact between the folded flaps provides for a continuous secure seal.

Furthermore, in order to form the flaps of the cup, no significant alteration to the structure of a conventional known frusto-conical cup having a generally circular rim lying in one plane is required, apart from the provision of the above-described specifically configured crease lines. There are no additional specifically provided elements of the flaps, which would otherwise project beyond the boundaries of a regular frusto-conical cup, or cut-outs (e.g. for forming a spout) which would otherwise undermine the integrity of the regular cup. The flaps of the cup in their fully open upright positions are integral parts of the conical wall of the cup and their curvature does not differ from the curvature of the wall of the cup. Furthermore, the rims of the flaps are integral part of the generally circular rim of the cup and do not project beyond the rim of the cup. Accordingly, no substantial alteration to an existing process of manufacturing of a regular frusto-conical cup is required. Another advantageous feature of the flaps of the cup is that a spout of the cup is also formed using the same flaps and without the need of altering the regular appearance and/or structure of the existing frusto-conical cups.

In one convenient arrangement, an elongate tab extends longitudinally along the wall of the cup and is attached to the wall of the cup along a detachment line, the elongate tab being detachable from the wall of the cup along the detachment line and the elongate tab being sufficiently rigid to be capable of being used as a stirrer for a beverage upon detachment. The elongate tab can be formed, for example, by leaving a free elongate portion of one of a pair of longitudinal edges of a die cut wall of the cup when joining the longitudinal edges when forming the wall of the cup. The detachment line can be formed by forming a plurality of perforations in the material of the tab adjacent the location where the tab is joined with the wall of the cup. Alternatively, a separate elongate tab can be removably attached to the wall of the cup.

DETAILED DESCRIPTION OF PREFERRED EMBODIMENTS

The invention will now be described with reference to the accompanying drawings which show, by way of example only, embodiments of a cup according to the invention. In the drawings.

Figures 1, 2, 3:
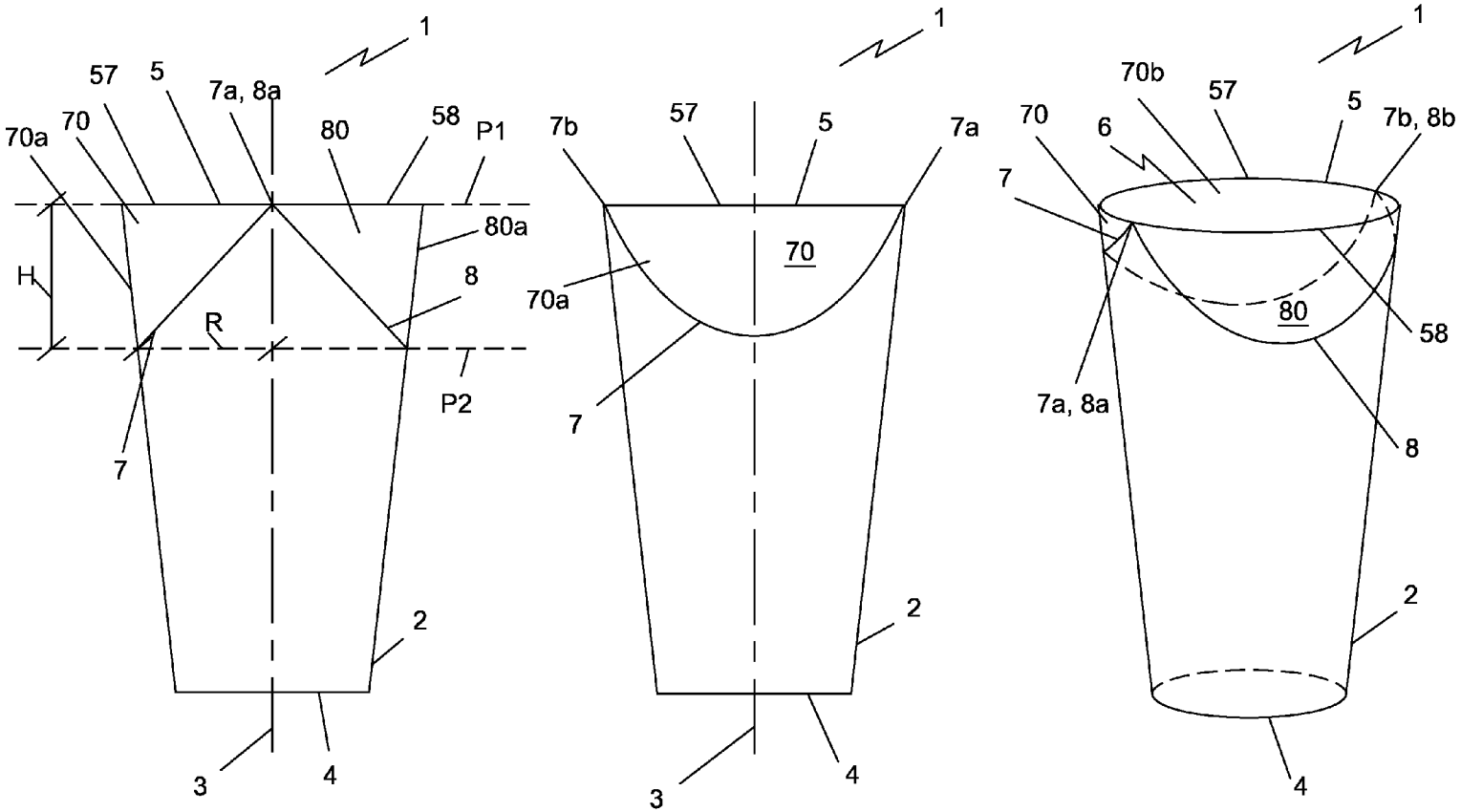
FIG. 1 is a side elevation of a cup according to the invention.
FIG. 2 is a front elevation of the cup of FIG. 1.
FIG. 3 is a perspective view of the cup of FIG. 1.

Referring initially to FIGS. 1 to 8, a cup in accordance with the invention is indicated generally by reference numeral 1. The cup 1 is made from a flexible resilient material, such as paperboard or a plastics material.

The cup 1 has a wall having a shape of a truncated cone having a central axis 3, a closed base 4 of a smaller diameter at one end and a generally circular rim 5 of a larger diameter at an opposite end. It will be appreciated that the invention is not limited to a circular cross-section of the cup wall. Indeed, a generally oval cross-section of the cup is within the scope of the present invention. The rim 5 defines a top opening 6 of the cup 1.

A pair of substantially arcuate crease lines 7, 8 is formed in the wall 2 of the cup 1 at opposite sides of the wall 2 below the rim 5. Each crease line 7, 8 has first and second ends 7*a*, 8*a* and 7*b*, 8*b*, respectively. The ends of the crease lines 7*a*, 8*a*, 7*b*, 8*b* coincide with the rim 5. Also, in the embodiments of the cup of the invention shown in FIGS. 1 to 10 and 15 to 19, each end 7*a*, 7*b* of a first crease line 7 substantially coincides with a corresponding end 8*a*, 8*b* of the second crease line 8 on the rim 5 of the cup.

Each crease line 7, 8 and the respective portion 57, 58 of the rim 5 between the respective first and second ends 7, 7*b*; 8*a*, 8*b* of the crease line 7, 8 define a flap 70, 80, respectively. Each flap 70, 80 has an outer face 70*a*, 80*a* and an inner face 70*b*, 80*b*, respectively.

Figure 5:
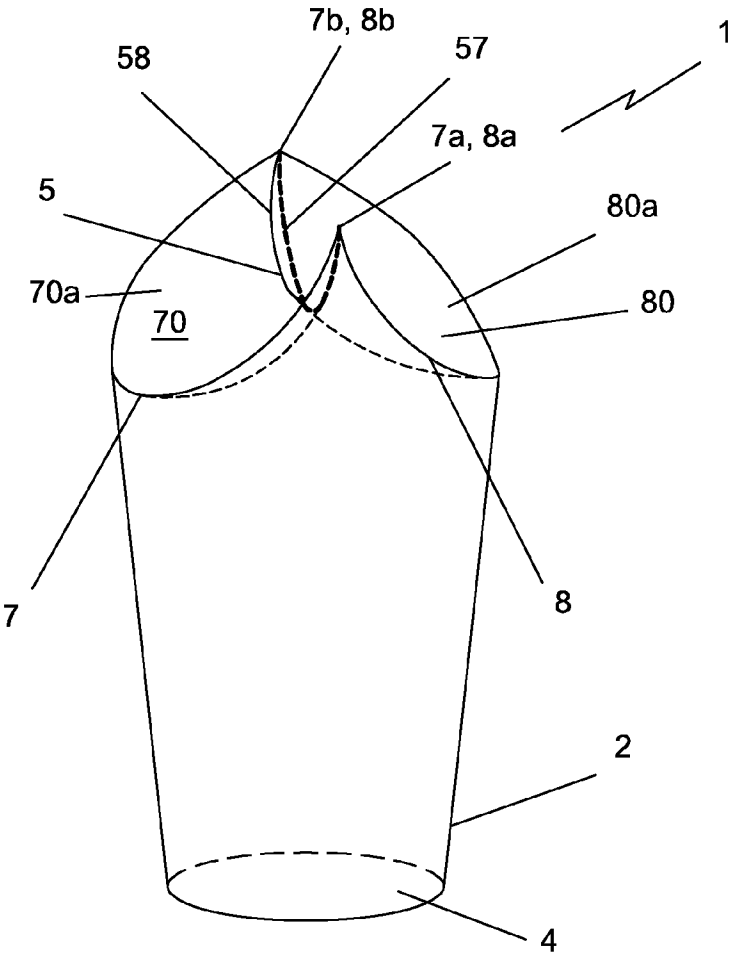
FIG. 5 is a perspective view of a fully closed cup of FIG. 1.
Figure 4:
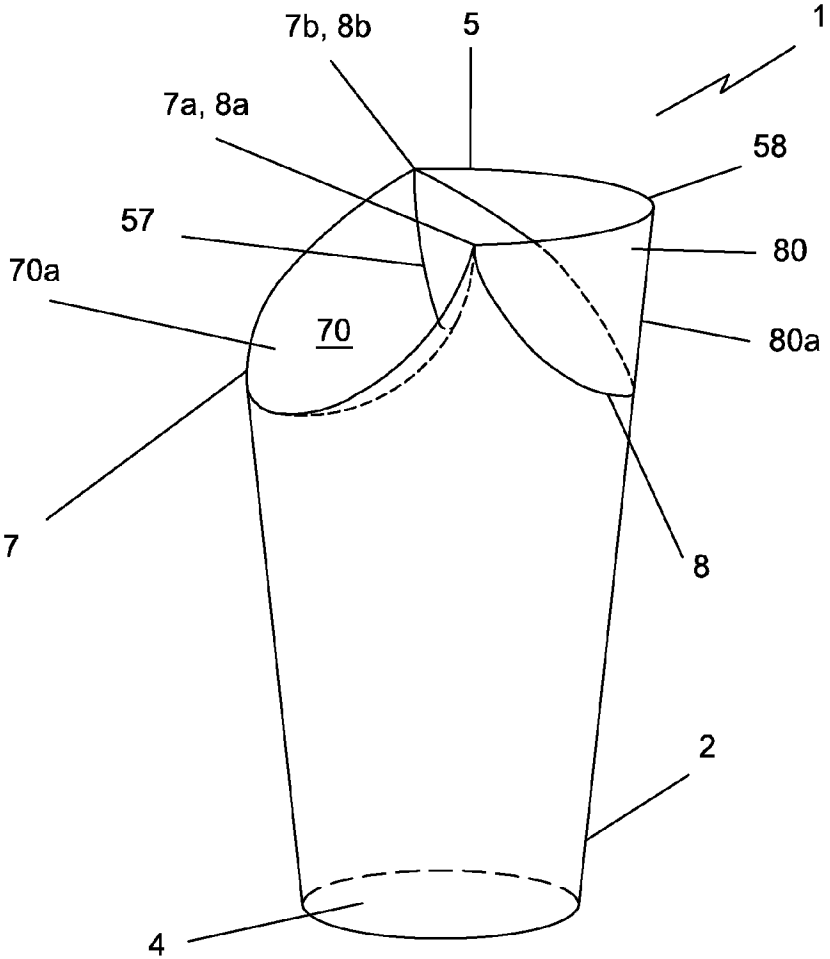
FIG. 4 is a perspective view of a partially closed cup of FIG. 1.
Figure 8:
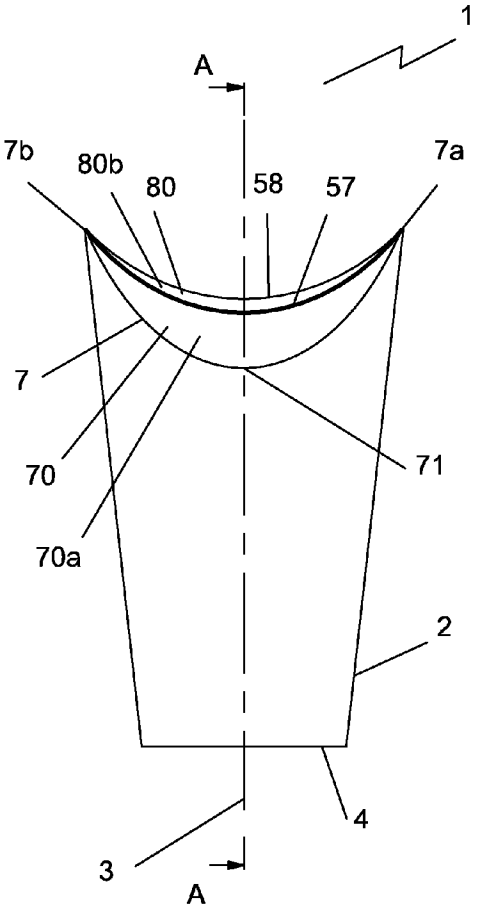
FIG. 8 is a front elevation of the closed cup of FIG. 5.
Figure 7:
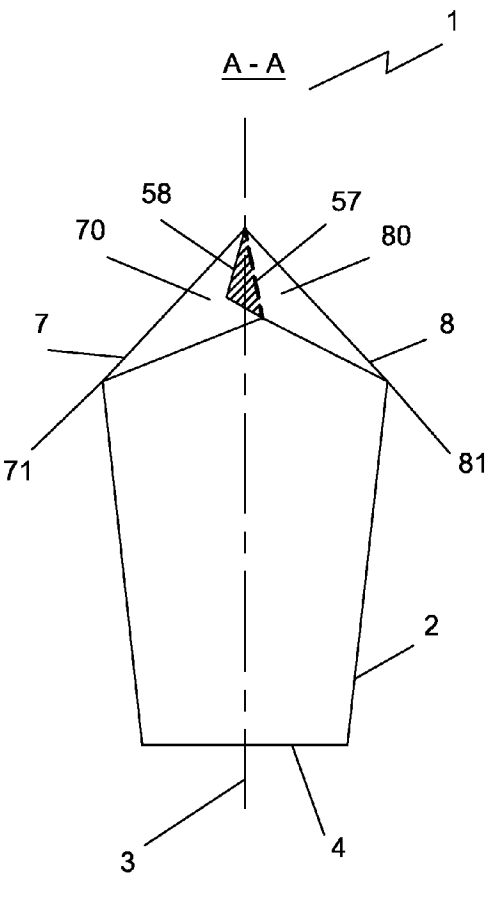
FIG. 7 is a cross-sectional elevation of the cup of FIG. 6 taken along the line A-A of FIG. 8.
Figure 6:
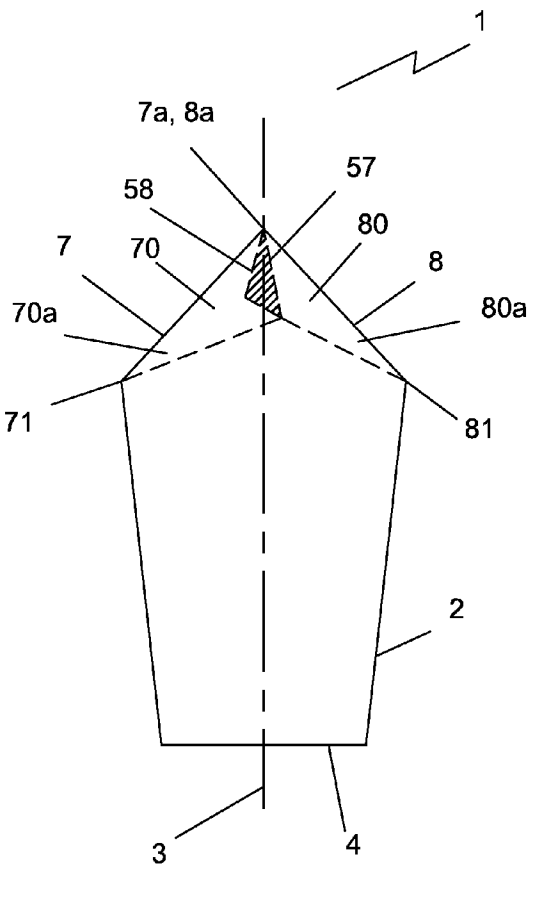
FIG. 6 is a side elevation of the closed cup of FIG. 5.

Each crease line 7, 8 is configured using a suitable method (e.g. by bending or scoring the material of the wall 2) to act as a hinge to allow each flap 70, 80 to toggle between two stable positions upon application of an initial external force on the flap 70, 80. One of the two stable positions is an open upright position in which the flap 70, 80 is convex and forms part of the wall 2 of the cup, for example, as shown in FIG. 1. The second of the two stable positions is a closed slanted position in which the flap 70, 80 changes its shape to concave, for example, as shown in FIGS. 4 and 5. A flap 70, 80 is prevented from remaining in a position intermediate the open upright and the closed slanted positions due to the resilience of its material and because in an intermediate position the flap 70, 80 becomes distorted, e.g. corrugated, because the length of the flap 70, 80 in the circumferential directions is greater the length of a plane defined by the respective crease line 7, 8. When pushed into an intermediate position by an external force and upon subsequent removal of the external force, the flap 70, 80 assumes either the concave shape in the closed slanted position or the convex shape in the open upright position under the influence of the inherent resilience of the cup material. The resilience of the cup material causes the flap 70, 80 to complete the toggle without the need for the continued application of the external force and prevents the flap 70, 80 from stopping in a position intermediate the open upright and the closed slanted positions.

The length of each crease line 7, 8 and the distance between a point 71, 81, respectively, of the crease line 7, 8 axially most remote from the rim 57, 58 of the flap 70, 80 and the rim 5 are such that when the flaps 70, 80 are closed, each flap 70, 80 assumes a slanted orientation in relation to the base 4 of the cup 1. Furthermore, a first flap, e.g. flap 70, is allowed to move fully into the closed slanted position as shown in FIG. 4. The second flap, i.e. flap 80, is prevented from moving fully into the closed slanted position by the rim 57 of the first flap which impinges against the inner face 80*b* of the second flap 80 substantially along the full length of the rim 57 of the first flap 70. The rim 57 of the first flap 70 is prevented from being deformed by the second flap 80 due to the resilience of the material of the first flap 70 (i.e. the material of the cup 1), while the second flap 80 remains statically forced against the rim 57 of the first flap 70 towards the fully closed slanted position due to the resilience of the material of the second flap 80 (i.e. the material of the cup 1), as shown in FIG. 5. Due to the continuous forced contact between the rim 57 of the first flap 70 and the inner face 80*b* of the second flap 80, a spill-tight seal is formed along the length of the rim 57 of the first flap 70. As shown in FIG. 5, the two flaps 70, 80 form a double-slope roof across the top opening 6 of the cup 1.

As is apparent from the drawings, the cup of the invention has the appearance of a regular well known frusto-conical cup, which has a generally circular rim and wherein all parts of the rim of the cup lie in one plane when the flaps 70, 80 are open, i.e. form a circle. Accordingly, the length of the rim 57, 58 of each respective flap 70, 80 is shorter than the length of the crease line 7, 8 of that flap 70, 80. Because the rim 57, 58 of each respective flap 70, 80 is shorter than crease line 7, 8 of the flap 70, 80, the flap 70, 80 assumes the inwardly slanted orientation with respect to the central axis 3 when the flap 70, 80 is toggled into the closed position. In the fully closed slanted position, the inherent resilience of the material of the cup 1 resists any further external force which attempts to push the flap 70, 80 down and/or inward any further, thereby rendering the flap 70, 80 substantially rigid and stable in the closed mode.

The counteracting forces between the rim 57 of the first flap 70 and the inner face 80*b* of the second flap 80 are sufficient to push the respective rim 57 and the inner face 80*b* together into a tight contact to form a spill-resistant, liquid tight seal capable of preventing the contents of the cup 1 from escaping the cup 1 by passing between the rim 57 of the first flap 70 and the inner face 80*b* of the second flap 80. Due to the configuration of the arcuate crease lines 7, 8 with respect to the rim 57, 58 of the respective flap 70, 80, the flaps 70, 80 assume the slanted orientation in relation to the base 4 of the cup 1 when the flaps 70, 80 are closed. At the same time, portions of the flaps 70, 80 adjacent their respective rims 57, 58 overlap at an angle to each other as shown in hatched lines in FIGS. 5, 6, 7, 10, 14 and 16 thereby enabling a line contact (i.e. rim-to-surface) between the flaps 70, 80, as opposed to a surface contact (surface-to-surface). As a result, a more reliable and secure seal is formed between the flaps 70, 80 and a more rigid structure of the cup in a closed mode is achieved. Furthermore, when the wall 2 of the cup 1 is gripped, the counteracting forces between the rim 57 and the inner face 80*b* of the respective first and second flaps 70, 80 increase, thereby further enhancing the sealing function of the flaps 70, 80.

Preferably, a height-radius ratio (H/R) of each flap 70, 80, i.e. the ratio between the shortest distance H (see FIG. 1) between two parallel planes P1, P2 both of which are perpendicular the central axis 4 of the cup 1 and the radius R of the cup 1 in the second plane P2 is equal or greater than 1, but preferably less than 1.5. A first plane P1 is the plane in which rim 5 of the cup 1 lies and the second plane P2 is the plane which passes through the points 71, 81 on the two crease lines 7, 8 axially most remote from the rim 5 of the cup 1. A shallower crease line 7, 8 (i.e. with H/R being less than 1) would not allow the flaps 70, 80 to come into any contact with each other upon closure of the flaps 70, 80 and a gap between the flaps 70, 80 would remain even in their closed mode. A steep crease line 7, 8 (i.e. with H/R being greater than 1.5) would cause central areas of the inner faces 70*b*, 80*b* of flaps 70, 80, respectively, to collide upon closure of the flaps 70, 80 and cause a surface-to-surface contact between the flaps 70, 80, as opposed to a forced rim-to-surface contact described above. At the same time, gaps will remain between the flaps 70, 80 adjacent the ends 7*a*, 8*a* and 7*b*, 8*b* of the crease lines 7, 8.

As is apparent from the drawings, substantially all points the crease line 7, 8 of a flap 70, 80, respectively, lie in one secant plane which crosses all the generating lines of the conical wall 2 and, as a result, define a part of an ellipse. The elliptical shape of the crease line 7, 8 provides for a more stable closed position of the flap and for a better matching contact between the rim 57 and the inner face 80*b* of respective folded flaps 70, 80. It will be appreciated that the invention is not limited to the elliptical shape of the crease lines 7, 8. It will also be appreciated that portions of each arcuate crease line 7, 8 can have different curvatures and, indeed, be straight. In one modification not shown in the drawings, the arcuate crease line 7, 8 includes a pair of substantially straight portions, each substantially straight portion being located intermediate the point 71, 81 on the cease line 7, 8, respectively, most remote from the rim 5 of the cup 1 and the first 7*a*, 8*a* and the second 7*b*, 8*b* end, respectively of the arcuate crease line 7, 8.

Figure 10:
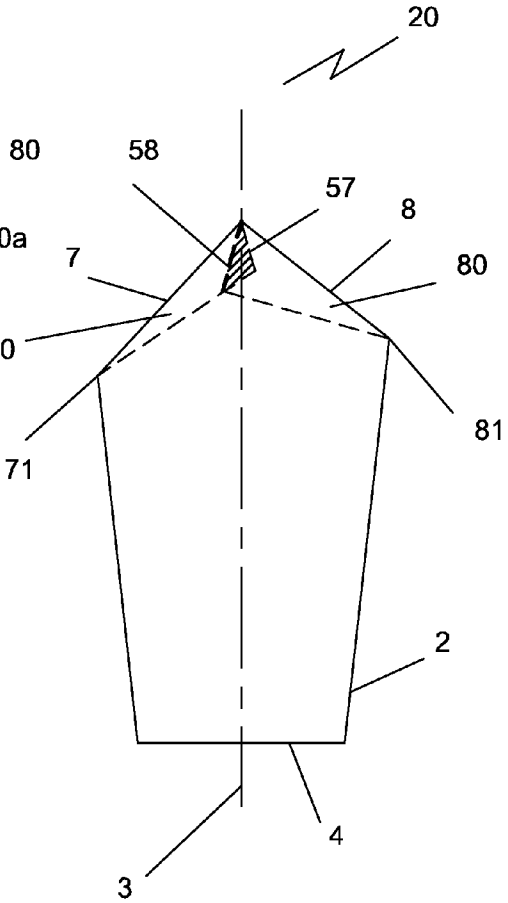
FIG. 10 is a side elevation a closed cup of FIG. 9.
Figure 9:
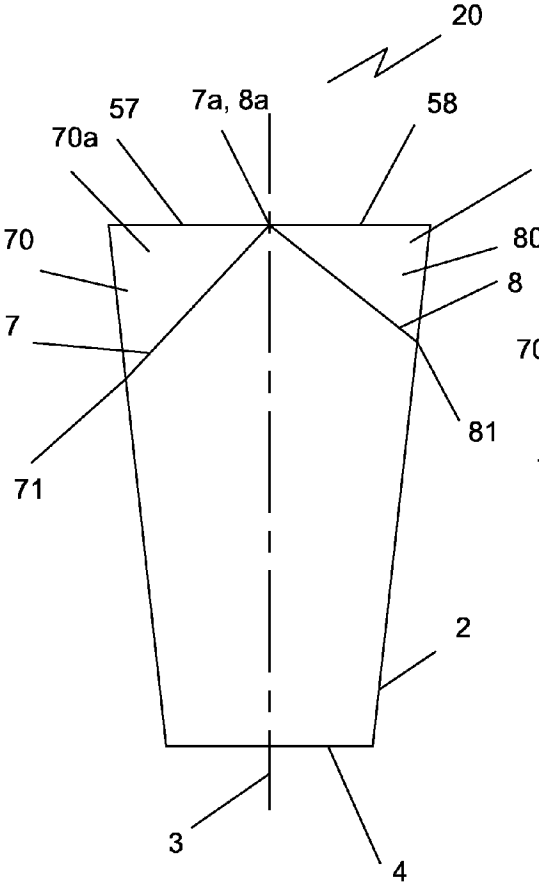
FIG. 9 is a side elevation of a modification of the cup of the invention.

In a modification of FIGS. 9 and 10, cup 20 is similar to cup 1 of FIGS. 1 to 8 and elements common to cups 1 and 20 are indicated using same reference numerals as for the cup 1. In the cup 20, the length of one crease line, for example, the crease line 8, is shorter than the length of the other crease line 7, and the distance between a point 81 of the crease line 8 most remote from the rim 5 of the cup 20 is less than the distance between a point 71 of the crease line 7 most remote from the rim 5 of the cup 20, i.e. the crease line 8 is shallower than the crease line 7 in relation to the base 4 of the cup 20. Due to this arrangement, when the flap 80 is folded into the fully closed position, as shown in FIG. 10, the rim 58 of the flap 80 is positioned closer to the top opening 6 of the cup 2 than the rim 57 of the flap 7 in the fully closed position, and than a rim 58 of the flap 80 having a crease line 8 identical to the crease line 7 of the flap 70. Therefore, the inner face 70*b* of the flap 70 meets the rim 58 of the flap 80 at a greater distance from the fully closed position of the flap 70 than in the arrangement where the crease lines 7, 8 of the two flaps 70, 80 are equal in length and are equally spaced from the rim 5 of the cup 20. As a result, the force that forces the inner face 70*b* of the flap 70 against the rim 58 of the flap 80 is greater than in the arrangement where the crease lines 57, 58 are equal and are equally spaced from the rim 5 of the cup 20, thereby providing for an enhanced sealing effect between the rim 58 of the flap 80 and the inner face 70*b* of the flap 70.

Figure 11:
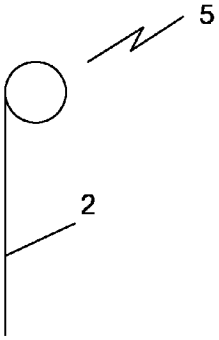
FIGS. 11 and 12 are enlarged side sectional views of a portion of the upper rim of the cup showing variations of the rim design of the cup.
Figure 12:
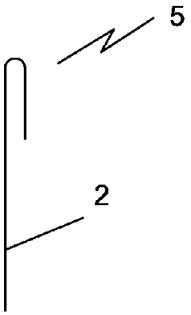

As shown in FIGS. 1 to 10 and 13 to 19, the rim 5 of the cup of the invention is a relatively sharp rim formed by cutting the cup material when forming the cup 1. The rim 5 provides for a line contact between the flaps 70, 80 and for a better sealing effect between the flaps 70, 80. In this arrangement, the cup material is preferably selected from a relatively dense material, such as high-density paperboard which has a relatively low liquid-absorbency. Nevertheless, as shown in FIG. 11, the rim 5 can also be a known regular outwardly curled rim. FIG. 12 shows a useful configuration of the rim 5 which is formed by folding over a band of material at the free edge of the cup wall on itself, such a rim being not too sharp to render the cup inconvenient for a user and not too round to prevent an efficient seal from being formed between the flaps 70, 80.

As described above, in the cups shown in FIGS. 1 to 10 and 15 to 19, each end 7*a*, 7*b* of one crease line 7 substantially coincides with a corresponding end 8*a*, 8*b* of the other crease line 8 on the rim 5 of the cup so that when the flaps 70, 80 are folded, the rim 57 of the flap 70 sealingly impinges against the inner face 80*b* of the other flap 80 along its entire length, i.e. from one pair of coinciding ends 7*a*, 8*a* of the crease lines 7, 8 to the other pair 7*b*, 8*b*, thereby preventing the contents of the cup from escaping from the interior of the cup.

Figures 13, 14, 15, 16:
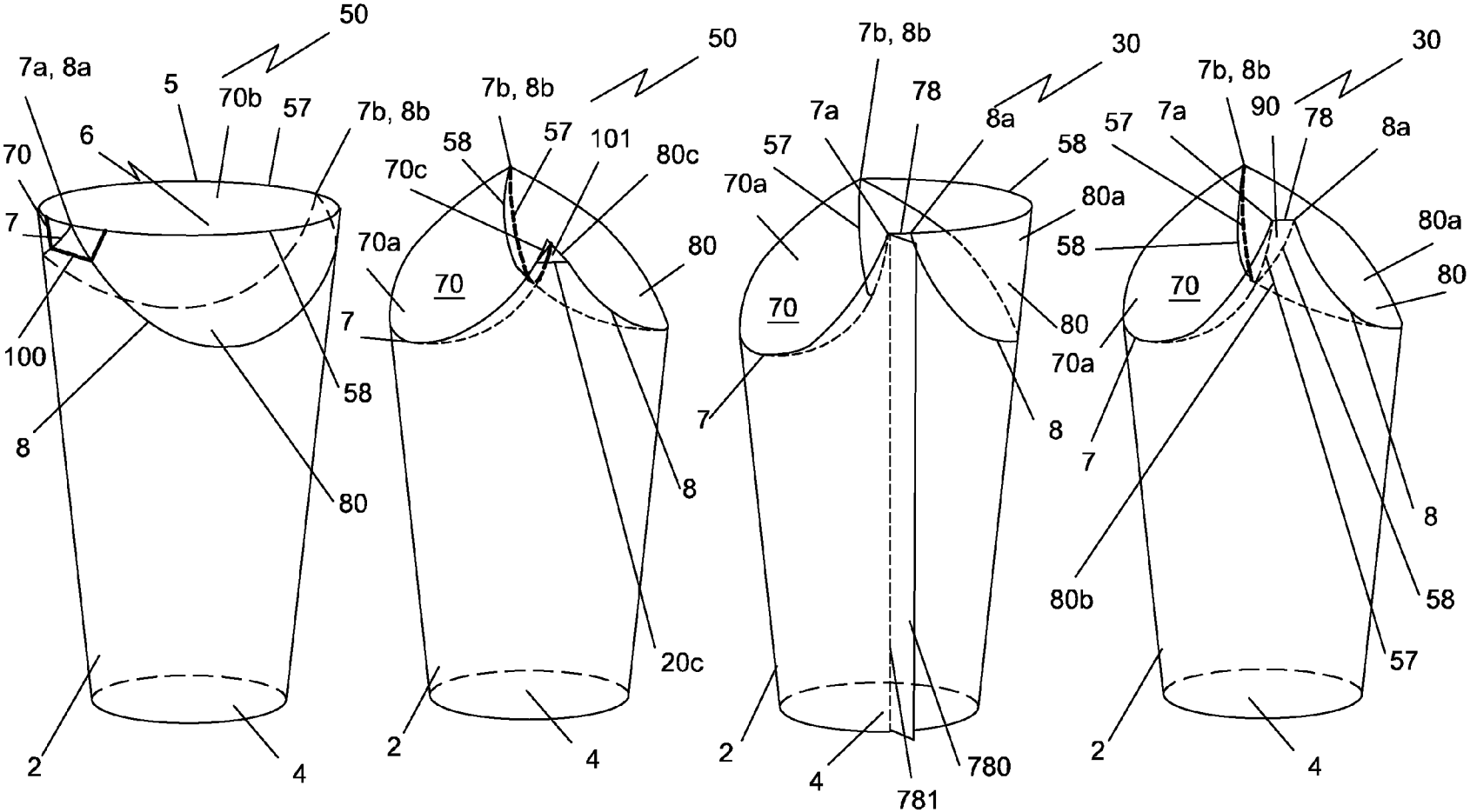
FIG. 13 is a perspective view of a further variation of the cup of the invention.
FIG. 14 is a perspective view of a closed cup of FIG. 13.
FIG. 15 is a perspective view of yet a further variation of the cup of the invention.
FIG. 16 is a perspective view of a closed cup of FIG. 15.

A cup 30 is shown in FIGS. 13 and 14 which is similar to the cup 1 of FIGS. 1 to 8 and in which elements common to cups 1 and 30 are indicated using same reference numerals as for the cup 1. A first pair of ends 7*b*, 8*b* of the two crease lines 7, 8 of the cup 30 coincide with each other and the other pair of ends 7*a*, 7*b* of the crease lines 7, 8 are spaced apart along the rim 5 of the cup 3 defining a bridge portion 78 of the rim 5. As shown in FIG. 14, when the flaps 70, 80 are closed, a portion of the rim 57 of the first flap 70 adjacent the bridge portion 78 remains spaced apart form the inner face 80*b* of the second flap 80, whereas the remaining portion of the rim 57 of the flap 70 is in the forced sealing contact with the inner face 80*b* of the other flap 80. The bridge portion 78 of the rim 5 of the cup 30 and the unsealed portions of the flaps 70, 80 define an opening sufficient to serve as a spout 90 of the cup 30. The spout 90 is suitable for drinking a beverage directly from the cup 30 and/or for inserting a drinking straw into the cup 30 through the spout 90.

As shown in FIG. 13, an elongate tab 780 extends longitudinally along the wall 2 of the cup 1. The tab 780 is attached to the wall of the cup along a detachment line 781. The tab 780 is detachable from the wall 2 of the cup 1 along the detachment line 781. The tab 780 is sufficiently rigid to be capable of being used as a stirrer for a beverage upon detachment. The elongate tab 780 can be formed, for example, by leaving a free elongate portion of one of none of a pair of longitudinal edges of a die cup wall 2 of the cup 1 when joining the longitudinal edges when forming the wall 2 of the cup 1. The detachment line 781 is formed by forming a plurality of perforations in the material of the tab 780 adjacent the location where the tab 780 is joined with the wall 2 of the cup 1.

Figure 19:
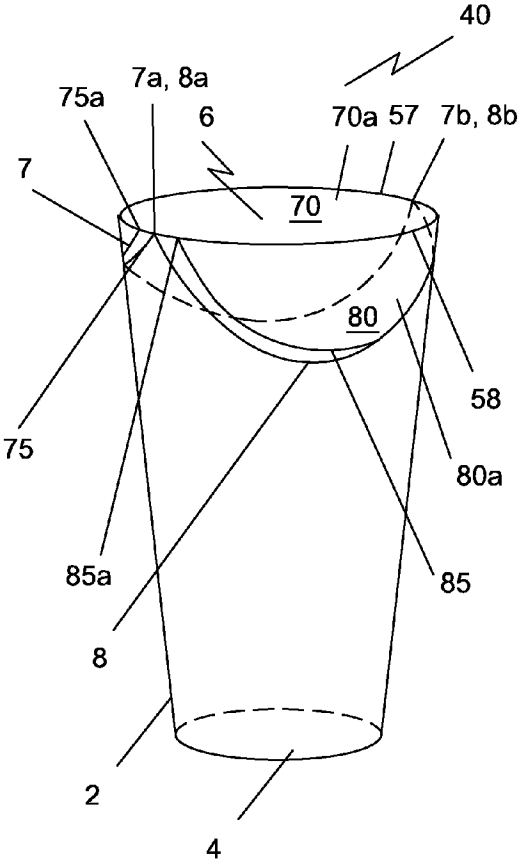
FIG. 19 is a perspective view of the cup of FIG. 17.
Figure 18:
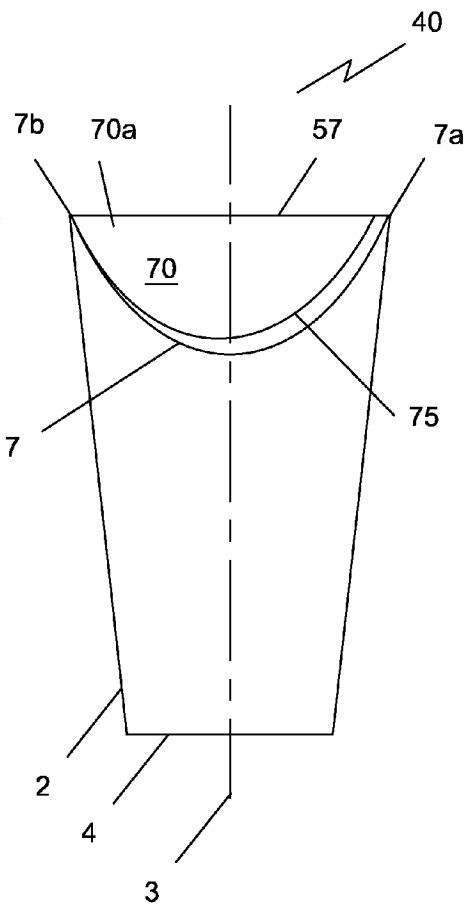
FIG. 18 is a front elevation of the cup of FIG. 17.
Figure 17:
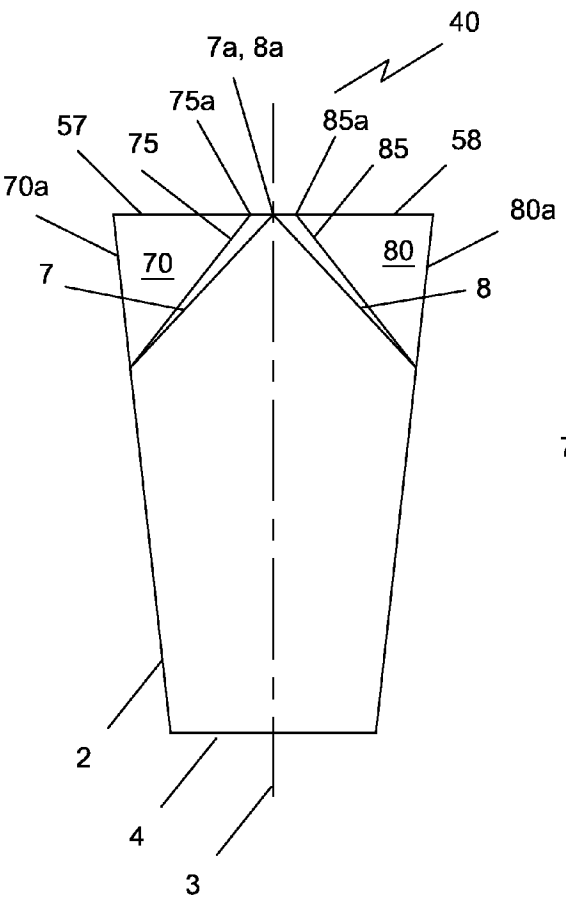
FIG. 17 is a side elevation of a still further modification of the cup of the invention.

A cup 40 is shown in FIGS. 17 to 19 which is similar to the cup 1 of FIGS. 1 to 8 and cup 30 of FIGS. 13 and 14 and in which elements common to cups 1, 30 and 40 are indicated using same reference numerals as for the cups 1 and 30. In the cup 4, a first pair of crease lines 7, 8 is provided wherein each end 7*a*, 7*b* of one crease line 7, substantially coincides with a corresponding end 8*a*, 8*b* of the other crease line 8 on the rim 5 of the cup 40 as described above with reference to FIGS. 1 to 8 to seal the top opening 6 of the cup 40 completely. Additionally, a second pair of arcuate crease lines 75, 85 is provided on each side of the wall 2 of the cup 40 upwardly offset from the corresponding crease line 7, 8 of the first pair. Ends 75*a*, 85*a* of each crease line 75, 85 of the second pair are spaced apart from each other along the rim 5 of the cup 40 defining a bridge portion 78. Accordingly, in one mode the flaps 70, 80 can be folded along the first pair of crease lines 7, 8 in order to close the top opening 6 of the cup 40 fully. In another mode, the flaps 70, 80 can be folded along the second pair of crease lines 75, 85. In this mode, a portion of the rim 57 of the first flap 70 adjacent the bridge portion 78 of the rim 5 of the cup 40 remains spaced apart from the inner face 80*b* of the folded second flap 80, whereas the remaining portion of the rim 57 of the first flap 70 is in the forced sealing contact with the inner face 80*b* of the second flap 80. The bridge portion 78 of the rim 5 of the cup 40 and the unsealed portions of the flaps 70, 80 define a spout (not shown) substantially as described above with reference to FIGS. 13 and 14.

A cup 50 is shown in FIGS. 15 and 16 which is similar to the cup 1 of FIGS. 1 to 8 and in which elements common to cups 1 and 50 are indicated using same reference numerals as for the cup 1. In the cup 50, a substantially continuous tear line 100 is formed extending from a rim 57 of the first flap 70 to the crease line 7 of the first flap 70; from the crease line 7 of the first flap 70 to the crease line 8 of the second flap 80 across the wall 2 of the cup 50; and from the crease line 8 of the second flap 80 to the rim 58 of the second flap 80 adjacent a location where the corresponding ends 7*a*, 8*a* of the first and second crease lines 7, 8 coincide on the rim 5 of the cup 50. The tear line 100 is formed so that when the flaps 70, 80 are closed, the tear line 100 encompasses a portion of the cup wall 2 and portions of the flaps 70, 80 adjacent the point on the rim 5 where the corresponding ends 7*a*, 8*a* of the two crease lines 7, 8 meet. Accordingly, upon gripping and applying a force to these portions surrounded by the tear line 100, the tear line 100 becomes broken and the portions of the wall 2 of the cup 50 and of the flaps 70, 80 originally surrounded by the tear line 100 become separated from the cup 50 thereby forming a spout 101 defined by edges 20*a*, 70*c* and 80*c* of the cup wall 2 and the flaps 70, 80, respectively exposed, after the separation. Like the spout 90 of the cup 30 described above, the spout 101 is suitable for drinking a beverage directly from the cup 50 and/or for inserting a drinking straw into the cup 50 through the spout 101.

It will be appreciated by those skilled in the art that variations and modifications can be made without departing from the scope of the invention as defined in the appended claims.

The invention claimed is:

1. A cup made from a flexible resilient material, the cup comprising:

a wall having a shape of a truncated cone having a central axis, a closed base of a smaller diameter at one end and a generally circular or oval rim of a larger diameter at an opposite end;

the rim defining a top opening of the cup, the cup further comprising:

a first flap and a second flap;

first and second substantially arcuate crease lines formed in the wall of the cup at opposite sides of the wall below the rim; wherein each crease line has first and second ends coinciding with the rim; wherein each crease line and the portion of the rim between the first and second ends of the crease line define each flap having an outer face and an inner face; wherein each crease line is configured to act as a hinge allowing each flap to toggle between two stable positions upon application of an initial external force on the flap, the two stable positions being an open upright position in which the flap is convex and forms part of the wall of the cup, and a closed slanted position in which the flap changes its shape to concave; wherein the resilience of the flap material causes the flap to complete the toggle and prevents the flap from stopping in a position intermediate the open upright and the closed slanted positions; and wherein the length of each crease line and the shortest distance between a point of the crease line axially most remote from the rim of the flap and the rim are selected such that when the flaps are closed, each flap assumes a slanted orientation in relation to the base of the cup, whereby the rim of the first flap impinges against the inner face of the second flap whereby the second flap remains statically forced against the rim of the first flap due to the resilience of the material of the cup thereby forming a spill-tight seal between the rim of the first flap and the inner face of the second flap, whereby the two flaps form a double slope roof across the top opening of the cup.

2. A cup as claimed in claim 1, wherein all parts of the rim of the cup lie in one plane when the flaps are open and the length of the rim of each flap is shorter than the length of the crease line of that flap.

3. A cup as claimed in claim 1, wherein the first flap is allowed to move fully into the closed slanted position, whilst the second flap is prevented from moving fully into the closed slanted position by the rim of the first flap, whereby the rim of the first flap is prevented from being deformed by the second flap due to the resilience of the material of the cup, so that the second flap remains statically forced against the rim of the first flap towards the closed slanted position due to the resilience of the cup material.

4. A cup as claimed in claim 1, wherein each flap is prevented from remaining in an intermediate position because in an intermediate position the flap becomes distorted and is forced to assume either a concave or a convex shape due to the inherent resilience of the cup material, whereby the resilience of the cup material causes the flap to complete the toggle without the need for the continued application of the external force.

5. A cup as claimed in claim 1, wherein the flap assumes the inwardly slanted orientation when the flap is toggled into the closed position.

6. A cup as claimed in claim 1, wherein in the closed position of the flaps, the inherent resilience of the material of the cup is substantially resistant to any external force attempting to push the flap down and/or inward any further, thereby rendering the flap substantially rigid and stable in the closed mode.

7. A cup as claimed in claim 1, wherein counteracting forces between the rim of the first flap and the inner face of the second flap are sufficient to push the respective rim and the inner face together into a tight contact to form a substantially spill-resistant, liquid-tight seal, such a seal is capable of preventing the contents of the cup from escaping the cup by passing between the rim of the first flap and the inner face of the second flap.

8. A cup as claimed in claim 1, wherein the configuration of the arcuate crease lines with respect to the rim of the respective flap is such that the flaps assume the slanted orientation when the flaps are closed and, accordingly, portions of the flaps adjacent their respective rims overlap at an angle to each other thereby forming a line contact between the flaps.

9. A cup as claimed in claim 1, wherein the rim of the first flap impinges against the inner face of the second flap along at least a greater portion of the length of the rim.

10. A cup as claimed in claim 1, wherein the rim of the first flap impinges against the inner face of the second flap substantially along the full length of the rim.

11. A cup as claimed in claim 1, wherein a height-radius ratio of each flap, i.e. the ratio between (a) the shortest distance between two parallel planes both of which are perpendicular the central axis of the cup, a first plane being the plane in which the rim of the cup lies and the second plane being a plane which passes through the point on one of the two arcuate crease lines axially most remote from the rim of the cup and (b) the radius of the cup in the second plane, is equal or greater than 1, but less than 1.5.

12. A cup as claimed in claim 1, wherein substantially all parts of the crease line of each flap lie in one respective secant plane which crosses the conical wall of the cup such that the crease line defines a part of an ellipse.

13. A cup as claimed in claim 1, wherein one or each arcuate crease line comprises portions having different curvatures.

14. A cup as claimed in claim 1, wherein one or each arcuate crease line comprises one or more straight portions.

15. A cup as claimed in claim 1, wherein one or each arcuate crease line includes a pair of substantially straight portions, each substantially straight portion being located intermediate a point on the cease line most remote from the rim of the cup and the first and the second end, respectively, of the arcuate crease line.

16. A cup as claimed in claim 1, wherein the material for the cup is selected from a range of flexible resilient materials including paperboard or plastics.

17. A cup as claimed in claim 1, wherein the rim of the cup is a relatively sharp rim.

18. A cup as claimed in claim 1, wherein the rim of the cup is formed by cutting the cup material when forming the cup.

19. A cup as claimed in claim 1, wherein the cup material is selected from a material with low liquid-absorbency, including a high-density paperboard, so that liquid contents of the cup does not penetrate and damage the cup material at the rim.

20. A cup as claimed in claim 1, wherein the rim is formed by folding over a band of material at the free edge of the cup wall outwardly or inwardly upon itself, wherein the resulting rim is not too sharp to render the cup inconvenient, not too round to prevent an efficient seal from being formed between the flaps and at the same time not as porous as a rim formed by cutting the cup material.

21. A cup as claimed in claim 1, wherein each end of one crease line substantially coincides with a corresponding end of the other crease line on the rim of the cup so that when the flaps are folded, the rim of one flap sealingly contacts the inner face of the other flap along its entire length, i.e. from one pair of coinciding ends of the crease lines of the flaps to the other pair, thereby substantially completely preventing the contents of the cup from escaping the cup.

22. A cup as claimed in claim 1, wherein a first pair of ends of the two crease lines coincide with each other and the other pair of ends of the crease lines are spaced apart along the rim of the cup defining therebetween a bridge portion of the rim, so that when the flaps are closed, a portion of the rim of the first flap adjacent the bridge portion of the rim of the cup remains spaced apart form the inner face of the second flap, whereas the remaining portion of the rim of the first flap is in the sealing contact with the inner face of the other flap, so that the bridge portion of the rim of the cup and the unsealed portions of the flaps define an opening sufficient to serve as a spout of the cup, the spout being suitable for drinking a beverage directly from the cup and/or for inserting a drinking straw into the cup through the spout.

23. A cup as claimed in claim 21, wherein a sealing arrangement is formed at the coinciding ends of the crease lines to seal any minuscule opening defined at the ends when the flaps are folded.

24. A cup as claimed in claim 23, wherein the sealing arrangement comprises an additional crease line extending between the crease line of a first flap and the rim of the first flap adjacent the coinciding ends of the first and the second flaps, thereby defining a sealing portion on the first flap, the sealing portion being foldable outwardly into substantial abutment with the remaining portion of the flap when the flaps are folded into the closed position, thereby sealing the minuscule opening.

25. A cup as claimed in claim 23, wherein the sealing arrangement comprises an additional crease line which extends between the crease lines of the first and the second flap adjacent the coinciding ends of the first and the second flaps thereby defining a sealing portion, the sealing portion being foldable inwardly or outwardly when the flaps have been folded into the closed position, thereby sealing the minuscule opening.

26. A cup as claimed in claim 1, wherein a first pair of crease lines is provided, wherein each end of one crease line substantially coincides with a corresponding end of the other crease line on the rim of the cup to seal the opening of the cup substantially completely when the flaps are closed and wherein, additionally, at least one third arcuate crease line is provided on one side of the wall of the cup upwardly offset from a first crease line of the first pair wherein, at least one end of the third crease line is spaced apart along the rim of the cup from the corresponding end of the second crease line of the first pair defining a bridge portion of the rim of the cup, whereby a first flap that has the third crease line can be folded along the third line, whereby a portion of the rim of the first flap adjacent the spaced apart ends of the third crease line and the second crease line of the first pair remains spaced apart form the inner face of the folded second flap, whereas the remaining portion of the rim of the first flap is in the sealing contact with the inner face of the other flap, so that the bridge portion of the rim of the cup and the unsealed portions of the flaps define a spout suitable for drinking directly therefrom or for inserting a straw.

27. A cup as claimed in claim 26, wherein a fourth arcuate crease line is provided on the opposite side of the wall of the cup similar to the third crease line upwardly offset form the second crease line of the first pair wherein at least one end of the fourth crease line is spaced apart along the rim of the cup from the corresponding end of the second crease line of the first pair and from the corresponding end of the third crease line, so as to define a bridge portion of the rim of the cup between the ends of the third and the fourth crease lines, so that the spout can be formed by folding the flaps along the third and the fourth lines.

28. A cup as claimed in claim 1, wherein the length of the first crease line is shorter than the length of the second crease line, and the distance between a point of the first crease line axially most remote from the rim of the cup is less than the distance between a point of the second crease line axially most remote from the rim of the cup, i.e. the first crease line is shallower than the second crease line in relation to the base of the cup, whereby when the first flap is folded into the fully closed position, the rim of the first flap is positioned closer to the top opening of the cup than the rim of the second flap in the fully closed position and than a rim of the first flap having a crease line identical to the crease line of the second flap, whereby the inner face of the second flap meets the rim of first flap at a greater distance from the fully closed position of second flap than in the arrangement where the crease lines of the two flaps are equal in length and are equally spaced from the rim of the cup and whereby the force that forces the inner face of the second flap against the rim of the first flap is greater than in the arrangement where the first and second crease lines are equal and are equally spaced from the rim of the cup.

29. A cup as claimed in claim 1, wherein a substantially continuous tear line is formed extending from the rim of the first flap to the crease line of the first flap; from the crease line of the first flap to the crease line of the second flap; and from the crease line of the second flap to the rim of the second flap adjacent a location where the corresponding ends of the first and second crease lines coincide on the rim of the cup.

30. A cup as claimed in claim 29, wherein the tear line is formed so that when the flaps are closed, the tear line encompasses a portion of the cup wall and portions of the flaps adjacent the point on the rim where the corresponding ends of the two crease lines meet, so that upon gripping and applying a force to these portions, the tear line becomes broken and the portions of the wall of the cup and of the flaps originally surrounded by the tear line become separated from the cup thereby forming a spout defined by edges of the cup wall and the flaps exposed after the separation.

31. A cup as claimed in claim 1, wherein an elongate tab extends longitudinally along the wall of the cup and is attached to the wall of the cup along a detachment line, the elongate tab being detachable from the wall of the cup along the detachment line and the elongate tab being sufficiently rigid to be capable of being used as a stirrer for a beverage upon detachment.

32. A cup as claimed in claim 31, wherein the elongate tab is formed by leaving a free elongate portion of one of a pair of longitudinal edges of a die cut wall of the cup when joining the longitudinal edges when forming the wall of the cup.

33. A cup as claimed in claim 31, wherein a separate elongate tab is removably attached to the wall of the cup.

34. A cup as claimed in claim 31, wherein the detachment line is formed by forming a plurality of perforations in the material of the tab adjacent the location where the tab is joined with the wall of the cup.

* * * * *